US007988412B2

(12) United States Patent
Hardwicke et al.

(10) Patent No.: US 7,988,412 B2
(45) Date of Patent: Aug. 2, 2011

(54) STRUCTURES FOR DAMPING OF TURBINE COMPONENTS

(75) Inventors: Canan Uslu Hardwicke, Simpsonville, SC (US); John McConnell Delvaux, Greer, SC (US); Bradley Taylor Boyer, Greenville, SC (US); James William Vehr, Easley, SC (US)

(73) Assignee: General Electric Company, Schenectady, NY (US)

( * ) Notice: Subject to any disclaimer, the term of this patent is extended or adjusted under 35 U.S.C. 154(b) by 1012 days.

(21) Appl. No.: 11/844,462

(22) Filed: Aug. 24, 2007

(65) Prior Publication Data

US 2009/0053068 A1 Feb. 26, 2009

(51) Int. Cl.
*F01D 5/16* (2006.01)

(52) U.S. Cl. ..... 416/1; 416/224; 416/229 R; 416/229 A; 416/230; 416/232; 416/241 R

(58) Field of Classification Search ..... 416/224, 416/229 R, 229 A, 230, 232, 241 R
See application file for complete search history.

(56) References Cited

U.S. PATENT DOCUMENTS

| | | | | | |
|---|---|---|---|---|---|
| 3,301,530 | A * | 1/1967 | Lull | 416/241 R |
| 3,758,233 | A * | 9/1973 | Cross et al. | 416/229 R |
| 5,593,526 | A * | 1/1997 | Yokouchi et al. | 156/89.15 |
| 5,687,679 | A * | 11/1997 | Mullin et al. | 123/41.79 |
| 5,720,597 | A * | 2/1998 | Wang et al. | 416/229 A |
| 5,791,879 | A * | 8/1998 | Fitzgerald et al. | 416/229 A |
| 5,931,641 | A * | 8/1999 | Finn et al. | 416/229 A |
| 6,059,533 | A * | 5/2000 | Stoker et al. | 416/241 B |
| 6,139,278 | A * | 10/2000 | Mowbray et al. | 416/229 A |
| 6,544,357 | B1 * | 4/2003 | Hehmann et al. | 148/420 |
| 7,147,899 | B2 * | 12/2006 | Fernihough et al. | 427/508 |
| 7,250,224 | B2 * | 7/2007 | Darolia et al. | 416/241 R |
| 2007/0081901 | A1 * | 4/2007 | Wagner et al. | 416/241 R |

* cited by examiner

*Primary Examiner* — Igor Kershteyn
(74) *Attorney, Agent, or Firm* — Cantor Colburn LLP

(57) ABSTRACT

Disclosed is a coating for gas turbine components including at least one material having vibration-damping properties. Further disclosed is an airfoil of a gas turbine having damped vibrational characteristics including an airfoil substrate and a coating applied to the airfoil substrate including at least one material having vibration-damping properties. A method of damping vibration of a gas turbine component includes applying a coating including at least one material having damping properties to the turbine component.

20 Claims, 3 Drawing Sheets

STRUCTURES FOR DAMPING OF TURBINE COMPONENTS

BACKGROUND

The subject invention relates to turbines. More particularly, the subject invention relates to damping of turbine components.

Operation of a turbine subjects many of the turbine components to vibrational stresses. This includes components of the compressor, hot gas path (HGP), and combustor sections of the gas turbine. Vibrational stresses shorten the fatigue life of components subjecting them to potential failure, especially when the components are also subjected to the harsh environment of a gas turbine.

One way to reduce vibrational stresses and extend the life of components is to provide a means for damping the vibration of the component thus altering vibrational characteristics in such a way to increase structural integrity of the component and extend its useful life. Previously, mechanical means have been used to damp vibration of turbine components. Examples of the mechanical means include a spring-like damper inserted in a rotor structure beneath the airfoil platform, or a damper included at the airfoil tip shroud.

BRIEF DESCRIPTION OF THE INVENTION

The present invention solves the aforementioned problems by modifying the surface of components subjected to harsh environments such as temperature, stress, noise, and vibration by adding at least one surface material having damping properties to the component. Further disclosed is an airfoil of a gas turbine having damped characteristics including an airfoil substrate and a surface structure applied to the airfoil substrate including at least one material having damping properties.

A method of damping vibration of a gas turbine component includes designing and applying a surface structure containing at least one layer having damping properties to the gas turbine component.

These and other advantages and features will become more apparent from the following description taken in conjunction with the drawings.

BRIEF DESCRIPTION OF THE DRAWINGS

The subject matter that is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Surface structures for turbine components, for example, gas turbine components, are disclosed which provide vibration damping at room temperature and above by absorbing vibration of the components and/or altering resonance frequencies of the components. The vibration damping increases fatigue lives of the components, for example, airfoils, compared to undamped components. Such surface structures may similarly be utilized to provide other forms of damping, for example, sound damping.

Figure 1:
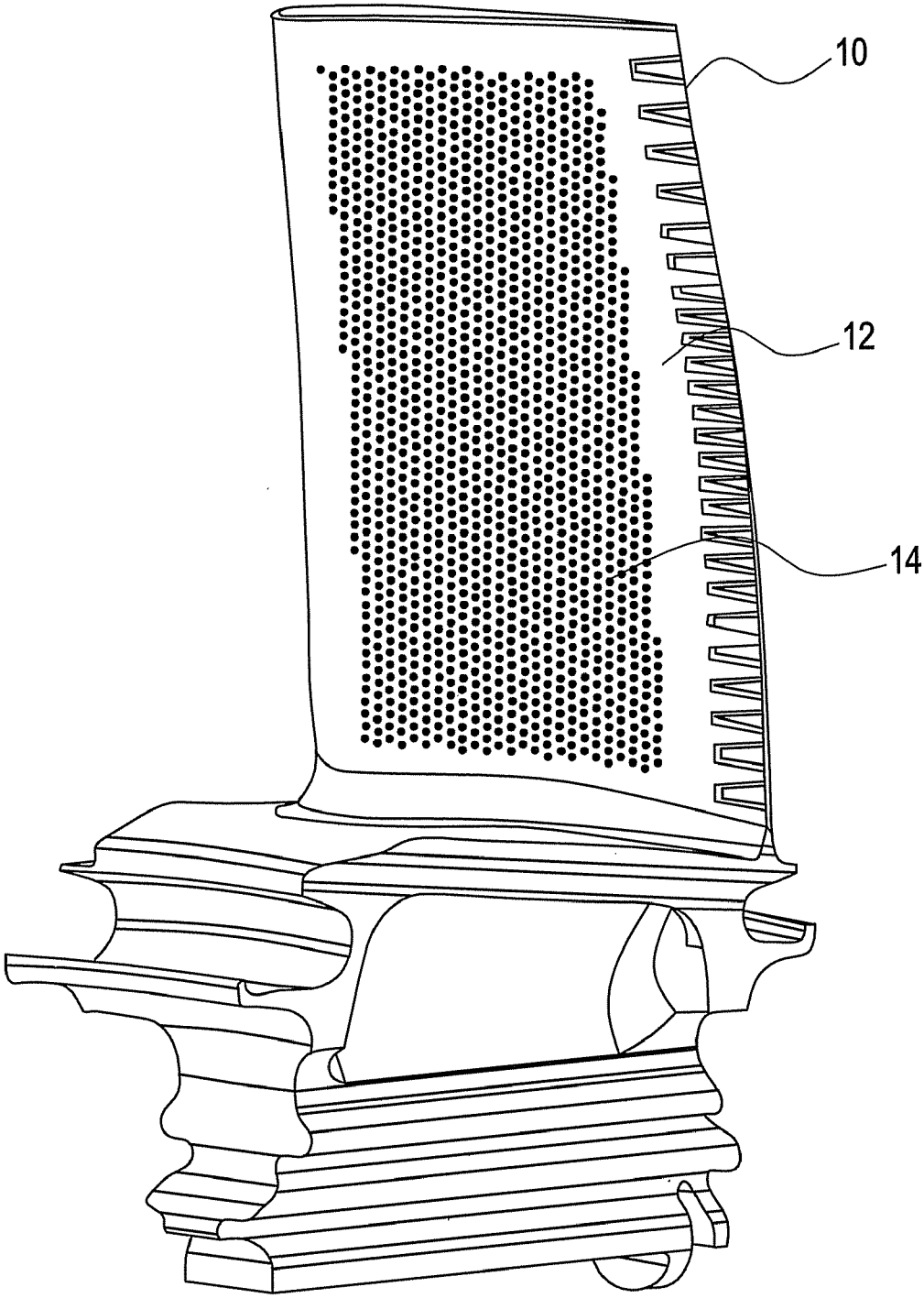
FIG. 1 is an example of an airfoil having damped vibrational characteristics.

Referring to FIG. 1, shown is a gas turbine component, for example an airfoil 10 with enhanced vibration damping. The airfoil 10 includes an airfoil substrate 12 and a surface structure 14 applied to the airfoil substrate 12. Surface structure 14 may contain one or more surface layers with varying properties. The surface structure 14 provides vibration damping characteristics when applied to the airfoil substrate 12. Embodiments of vibration damping surface structures 14 may utilize change in chemical, structural, and/or mechanical properties of at least one component of the surface structure 14 to provide the vibration damping characteristics at room temperature and above. An example of such property is movement and shifting of twin boundaries, the areas in a material where crystals intergrow. When an airfoil 10 or other component is exposed to vibration, the movement and shifting of the twin boundaries damps the vibration of the airfoil 10. Examples of a surface structure 14 in which such twin boundaries exist are a Cu—Mn alloy, and a Ni—Ti alloy.

Another property useful for vibration damping is a stress induced in any one component of the surface structure 14 by preferential orientation of axis joining pairs of solute atoms, an example of which is an alpha brass coating material, a brass having less than 35% zinc. Portions of surface structure 14 having intercrystalline thermal currents due to internal friction in the surface structure 14 also are useful in damping vibration. Intercrystalline thermal currents materialize in polycrystalline materials which are under cyclic stresses and are dissipating a maximum amount of energy.

An additional way to create vibration damping effects in surface structures 14 is to make use of known imperfections in the materials, or utilize materials which tend to have certain imperfections. The imperfections can include impurities, grain boundaries, point defects, and/or clusters of several such defects adjacent to one another. The imperfections produce hysteretic loop or damping effects under cyclic, vibratory stresses. For example, unit energy dissipated in a grain boundary is greater than the unit energy dissipated within the grain when the material is subjected to vibratory stress or strain. This inequity in energy dissipation produces the damping effect.

Materials having the above-described properties making them examples of materials that may be utilized in vibration-damping coatings 14 include copper alloys, examples of which are Cu—Zn brass, Cu—Fe—Sn bronze-Mn—Ni alloys and combinations thereof. Other candidate materials may include cobalt alloys including combinations of one or more of Co, Ni, Fe, Ti, and Mo; iron alloys including combinations of one or more of Fe, Mn, Si, Cr, Ni, W, Mo, Co, and C; magnesium alloys including combinations of one or more of Mg, Zn, Zr, Mn, and Th; manganese alloys including combinations of Mn, Cu, and/or Ni; and nickel alloys including Ni—Ti nitinol having 55% Ni and 45% Ti and combinations of one or more of Cr, Fe, and Ti. Vibration-damping coating materials also may include rhenium annealed at 1500 C for 1 hour, 1800 C for 1 hour and having a high loss coefficient at 1600 C; silver alloys including Ag—Cd, Ag—Sn, and Ag—In; tantalum annealed at 1850 C with a high loss coefficient at 1500 C; strontium having a 700 C high loss coefficient; titanium alloys including Ti-4Al-2Sn and Ti-6-4, although Ti-4Al-2Sn is preferred; and tungsten annealed at 1580 C-2000 C. Refractory materials can also be utilized, examples of which are MgO, $SiO_2$, $Si_3N_4$, and $ZrO_2$.

Figure 2:
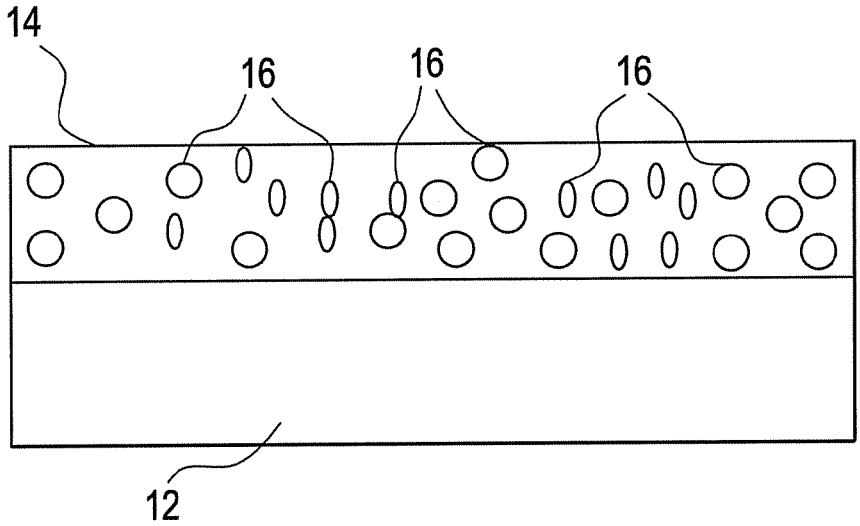
FIG. 2 is an illustration of an example of a coating for the airfoil of FIG. 1.
Figure 3:
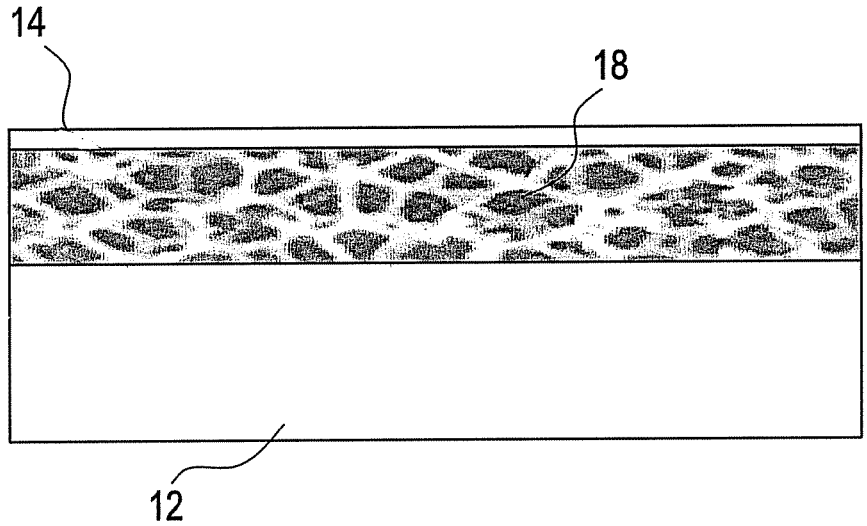
FIG. 3 is an illustration of another example of a coating for the airfoil of FIG. 1.
Figure 4:
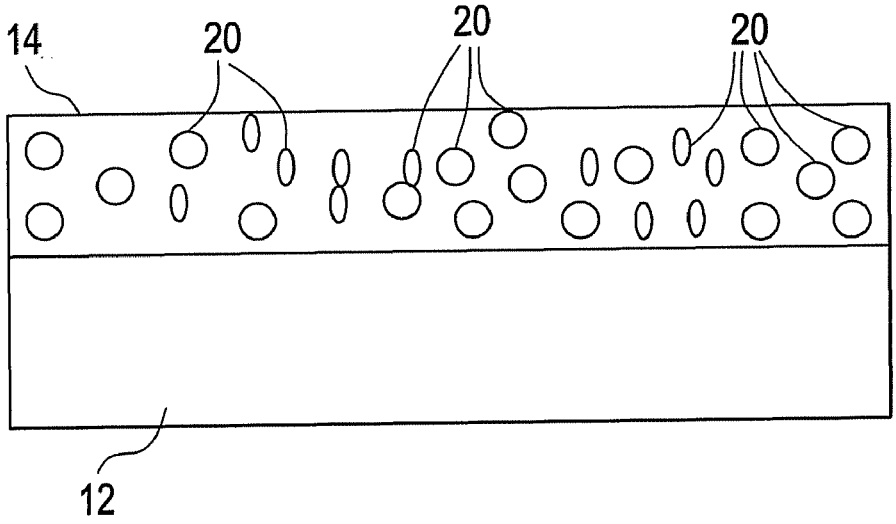
FIG. 4 is an illustration of a third example of a coating for the airfoil of FIG. 1.
Figure 5:
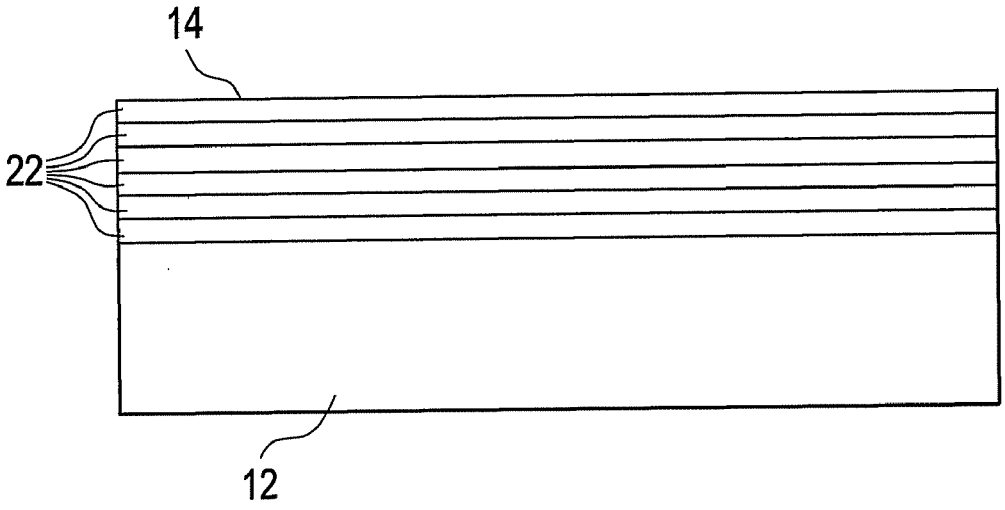
FIG. 5 is an illustration of a fourth example of a coating for the airfoil of FIG. 1.

In addition to utilizing microstructural properties or material properties to provide damping characteristics, other features may be included in the coating 14 to further enhance the vibration damping characteristics of the structure. As shown in FIG. 2, pores 16 may be incorporated in the surface structure 14, as can foams 18, as shown in FIG. 3, or microballoons 20, as shown in FIG. 4, to increase the surface structure 14's compressibility and high temperature viscoelasticity which increases the damping performance of the surface structure 14. The pores 16 may include micropores having diameters of 0.5-100 microns, nanopores of diameters of 15-500 nm, and/or macropores having diameters greater than 100 microns. Foams 18 may include metal/ceramic open cell foams, hollow-sphere foams, and/or metal-infiltrated ceramic foams. Microballoons 20 are a powder comprising clusters of glass spheres. Additionally, as shown in FIG. 5, the surface structure 14 may be applied to the airfoil substrate 12 in multiple layers 22, similar to a lamination, such that friction caused by relative motion between the layers 22 creates a vibration damping effect. Alternating layers in 22 can also have varying elastic moduli to create this internal friction.

The damping surface structures 14 described above may be applied to the desired gas turbine components by a number of appropriate methods depending on the substrate material and the coating material including cathodic arc, pulsed electron beam physical vapor deposition (EB-PVD), slurry deposition, electrolytic deposition, sol-gel deposition, spinning, thermal spray deposition such as high velocity oxy-fuel (HVOF), vacuum plasma spray (VPS) and air plasma spray (APS). It is to be appreciated, however that other methods of coating application may be utilized within the scope of this invention. The surface structures may be applied to the desired component surfaces in their entirety or applied only to critical areas of the component to be damped.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A surface structure for turbine components comprising:
a turbine component substrate; and
a coating applied to the turbine component substrate including at least one material having damping characteristics resulting from damping microstructural properties and imperfections in the at least one material.

2. The surface structure of claim 1 wherein the microstructural property is a preferential orientation of axis joining pairs of solute atoms in the at least one material.

3. The surface structure of claim 1 wherein the microstructural property is an intercrystalline thermal current in the at least one material.

4. The surface structure of claim 1 further comprising a plurality of pores.

5. The surface structure of claim 4 wherein at least one pore of the plurality of pores has a diameter in the range of 15 nanometers to 3 millimeters.

6. The surface structure of claim 1, wherein the coating further comprises one of at least one foam additive, a plurality of glass spheres in a metallic or ceramic matrix, a plurality of layers differing in their mechanical and chemical properties, and combinations including at least one of the foregoing.

7. An airfoil of a gas turbine having damped characteristics comprising:
an airfoil substrate; and
a surface structure coating applied to the airfoil substrate including at least one material having damping properties resulting from damping microstructural properties and imperfections in the at least one material.

8. The airfoil of claim 7 wherein the damping properties are one of vibration damping properties, sound damping properties, and a combination including of at least one of the foregoing.

9. The airfoil of claim 7 wherein the surface structure further comprises one of a plurality of pores, at least one foam additive, a plurality of glass spheres, and combinations including at least one of the foregoing.

10. The airfoil of claim 7 wherein the surface structure is applied to the gas turbine component in multiple layers.

11. The airfoil of claim 7 wherein the surface structure is applied to one or more damping-critical portions of the airfoil.

12. A method of damping a gas turbine component comprising applying a surface structure coating including at least one material having damping properties to a substrate of the gas turbine component, the damping properties resulting from damping microstructural properties and imperfections in the at least one material.

13. The method of claim 12 wherein the surface structure includes vibration damping properties.

14. The method of claim 12 wherein the surface structure includes sound damping properties.

15. The method of claim 12 wherein at least a portion of the surface structure is applied by a cathodic arc.

16. The method of claim 12 wherein the at least a portion of the surface structure is applied by an electron beam physical vapor deposition.

17. The method of claim 12 wherein at least a portion of the surface structure is applied by thermal spray.

18. The method of claim 12 wherein at least a portion of the surface structure is applied by slurry deposition.

19. The method of claim 12 wherein at least a portion of the surface structure is applied by electrolytic deposition.

20. The method of claim 12 wherein the surface structure is applied to one or more damping-critical portions of the component.

* * * * *